US007119528B1

(12) United States Patent
Rasmus

(10) Patent No.: US 7,119,528 B1
(45) Date of Patent: Oct. 10, 2006

(54) LOW VOLTAGE BANDGAP REFERENCE WITH POWER SUPPLY REJECTION

(75) Inventor: Todd Morgan Rasmus, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 32 days.

(21) Appl. No.: 11/115,913

(22) Filed: Apr. 26, 2005

(51) Int. Cl.
*G05F 3/16* (2006.01)

(52) U.S. Cl. ..... 323/317; 323/316; 327/539

(58) Field of Classification Search ..... 323/315, 323/316, 317; 327/538, 539
See application file for complete search history.

(56) References Cited

U.S. PATENT DOCUMENTS

| | | | | |
|---|---|---|---|---|
| 4,675,594 A * | 6/1987 | Reinke | 323/317 |
| 5,325,045 A | 6/1994 | Sundby | 323/313 |
| 5,955,873 A | 9/1999 | Maccarrone et al. | 323/114 |
| 6,121,824 A | 9/2000 | Opris | 327/539 |
| 6,188,270 B1 | 2/2001 | Boerstler | 327/543 |
| 6,407,622 B1 | 6/2002 | Opris | 327/539 |
| 6,489,835 B1 | 12/2002 | Yu et al. | 327/539 |
| 6,507,180 B1 | 1/2003 | Eguchi | 323/314 |
| 6,529,066 B1 | 3/2003 | Guenot et al. | 327/539 |
| 6,531,857 B1 | 3/2003 | Ju | 323/316 |
| 6,549,065 B1 | 4/2003 | Opris | 327/539 |
| 2003/0006747 A1 | 1/2003 | Jaussi et al. | 323/315 |
| 2003/0117120 A1 | 6/2003 | Amazeen | 323/313 |

* cited by examiner

*Primary Examiner*—Shawn Riley
(74) *Attorney, Agent, or Firm*—Sawyer Law Group LLP

(57) ABSTRACT

A bandgap reference generation circuit utilizes two feedback loops to maintain the voltage at across the current sources to be essentially the same, such that the reference voltage remains constant over variations in process, temperature, and supply voltage. The accuracy of the reference voltage is maintained even at low supply voltages. Furthermore, the feedback loops increase the output impedance of the current sources, reducing the amount of noise coupling from the power supply, improving power supply rejection ratio.

11 Claims, 5 Drawing Sheets

LOW VOLTAGE BANDGAP REFERENCE WITH POWER SUPPLY REJECTION

FIELD OF THE INVENTION

The present invention relates to voltage bandgap references circuits, and more particularly to such bandgap references circuits with low supply voltages.

BACKGROUND OF THE INVENTION

Bandgap reference generation circuits are well known in the art. Their purpose is to provide a stable reference voltage which is relatively insensitive to process, temperature, and supply voltage variations. FIGS. 1 through 3 illustrate conventional bandgap reference generation circuits. The bandgap reference circuit represented in FIG. 1 includes an operational amplifier (op amp) 101, a current source 102, and two bias paths, connected as illustrated. The first bias path includes a resistor 103 and a diode 106. The second bias path includes resistors 104 and 105 and diodes 107–108. Nodes A and B connect to the inputs of op amp 101, the voltage output of op amp 101 controls the current magnitude of the current source 102. These connections form a negative feedback control loop which forces the node potentials of nodes A and B to be essentially identical. Properly biased in this fashion, the reference voltage, $V_{OUT}$, equals VD+RA/RB ($V_t$ ln(N)) where VD is the forward voltage of diode 106, and $V_t$ is the thermal voltage. This bandgap reference provides a reference voltage ($V_{OUT}$) of approximately 1.2V from a supply voltage of 1.6V or greater.

The bandgap reference circuit represented in FIG. 2 includes an op amp 201 and two bias paths, connected as illustrated. The first bias path includes a first current source 202, resistor 205, and diode 206. The second bias path includes a second current source 203, resistors 207 and 208, and diodes 209–210. Nodes A and B connect to the inputs of op amp 201, while the voltage output of op amp 201 controls the current magnitude of both current sources 202–203. These connections form a negative feedback control loop which forces the potentials of nodes A and B to be essentially identical. If the electrical parameters of current sources 202–203 are well matched, this negative feedback network forces the current magnitudes in both current sources 202–203 and bias paths to be equal. Furthermore, if the electrical parameters of current source 204 are well matched to current sources 202–203, the magnitude of current source 204 will be essentially equal to the current in the sources 202–203. Because the forward voltage VD of diode 206 decreases linearly with temperature, the current in resistors 205 and 207 also decrease linearly with temperature. Such behavior is known as complimentary to absolute temperature (CTAT). Conversely, the current in resistor 208 is found to increase linearly with temperature, yielding a behavior known as proportional to absolute temperature (PTAT). If the CTAT and PTAT behaviors are carefully selected to be complimentary, the sum of both yields a behavior which does not change with temperature. Thus, the current magnitudes in sources 202, 203, and 204 do not change with temperature, as they are comprised of the sum of both CTAT and PTAT currents. Thus, the reference voltage, $V_{OUT}$, across resistor 211 is thus equal to (RC/RA)VD+(RA/RB) ($V_t$ ln(N)), and is relatively insensitive to temperature, process, and power supply variations.

The recent trend in the microelectronics industry is to utilize lower power supply voltage potentials in order to reduce on-chip power dissipation. Such low supply voltages have created serious bias problems for prior art bandgap reference circuits. At a supply voltage of 0.8V, for example, both bandgap reference circuits illustrated in FIGS. 1 and 2 begin to develop significant output voltage errors. These errors are caused by many factors, including the mistracking of the currents between current sources 202–204 due to differing output impedances of each source at lower voltages. Generally, this mistracking becomes more profound as the supply voltage drops, particularly when the current sources are implemented with CMOS (complementary metal-oxide silicon) technologies. CMOS transistors yield limited output impedance and are subject to local transistor-to-transistor mistracking. As the supply is reduced, the voltage across the transistor can become limited, reducing the output impedance and hence the current flow through the transistor.

Additionally, at lower supply voltages, more noise can couple from the power supply through the current source to the bandgap voltage output. One measurement of noise immunity is called PSRR (power supply rejection ratio). Generally, PSRR drops as the output impedance of currents 202–204 drops, as additional noise currents are allowed to flow through this low impedance pathway. If the output impedance of current sources 202–204 is high relative to the load resistance 211, then less noise will appear at $V_{OUT}$. These output impedances are represented as resistors 301–303 across the current sources 202–204, as illustrated in FIG. 3. However, if the output impedance of current sources 202–204 is low relative to the load resistance 211, then more noise will appear at Vout, compromising the performance of the bandgap reference circuit.

Accordingly, there exists a need for an improved bandgap reference generation circuit. The improved bandgap reference circuit should improve error tolerance at low supply voltages over conventional bandgap reference circuits and incorporate temperature compensation mirroring. The present invention addresses such a need.

SUMMARY OF THE INVENTION

An improved bandgap reference generation circuit utilizes two feedback loops to maintain the voltage at across the current sources to be essentially the same, such that the reference voltage remains constant over variations in process, temperature, and supply voltage. The accuracy of the reference voltage is maintained even at low supply voltages. Furthermore, the feedback loops increase the output impedance of the current sources, reducing the amount of noise coupling from the power supply, improving power supply rejection ratio.

DETAILED DESCRIPTION

The present invention provides an improved bandgap reference generation circuit. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown but is to be accorded the widest scope consistent with the principles and features described herein.

To more particularly describe the features of the present invention, please refer to FIGS. 4 and 5 in conjunction with the discussion below.

Figure 1:
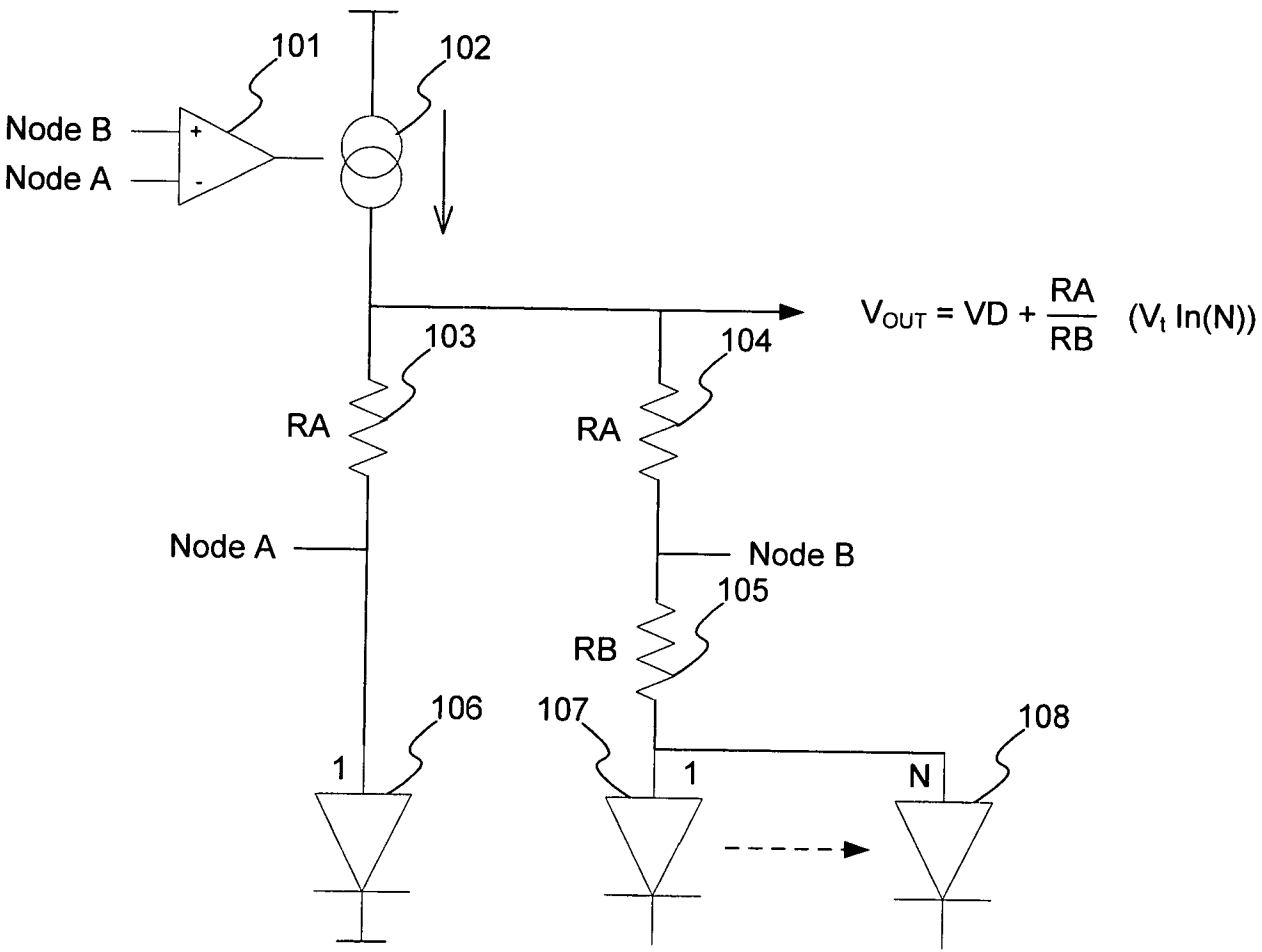
FIG. 1 (Prior Art)
FIGS. 1 through 3 illustrate conventional bandgap reference generation circuits.
Figure 2:
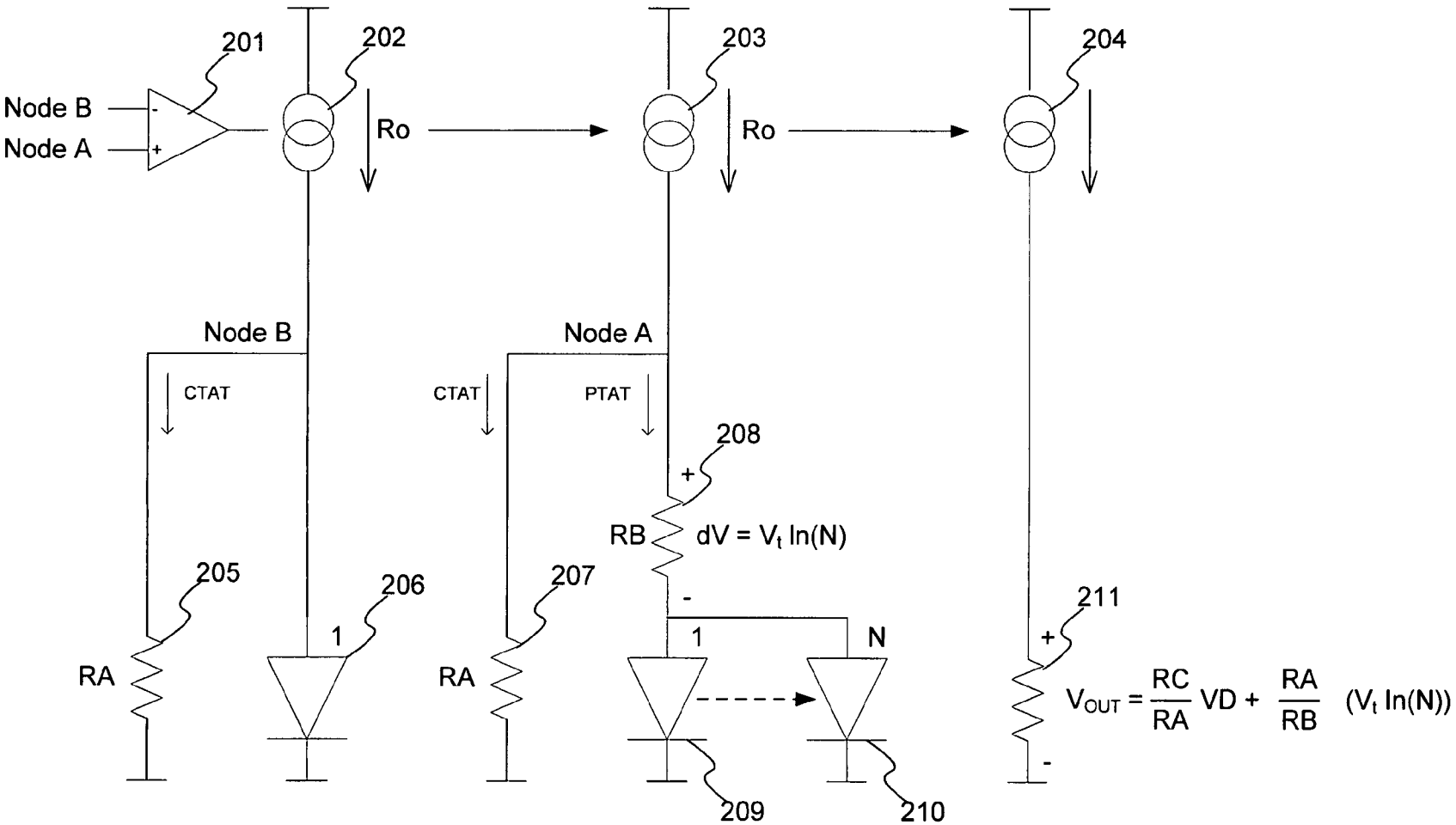
FIG. 2 (Prior Art)
Figure 3:
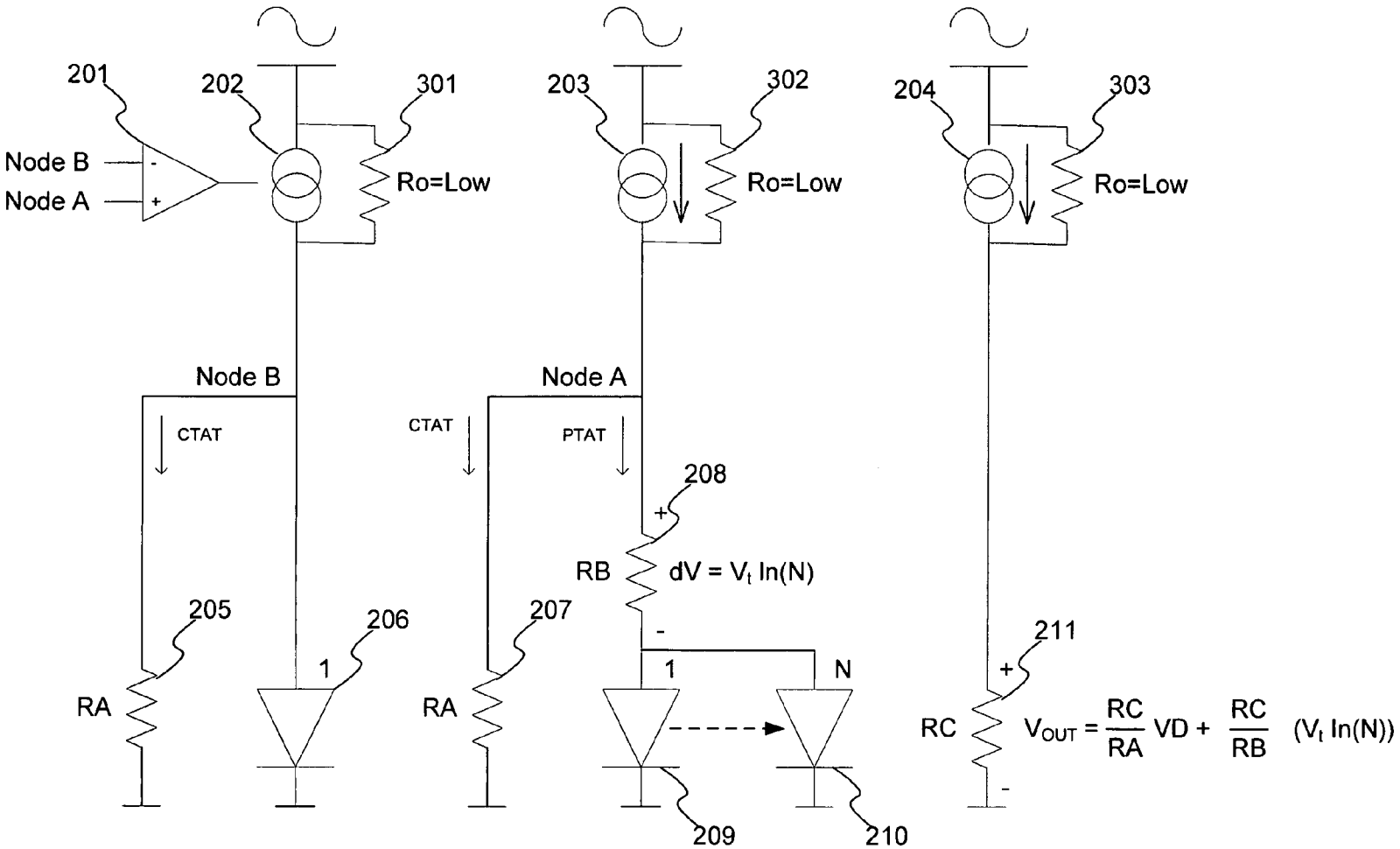
FIG. 3 (Prior Art)
Figure 4:
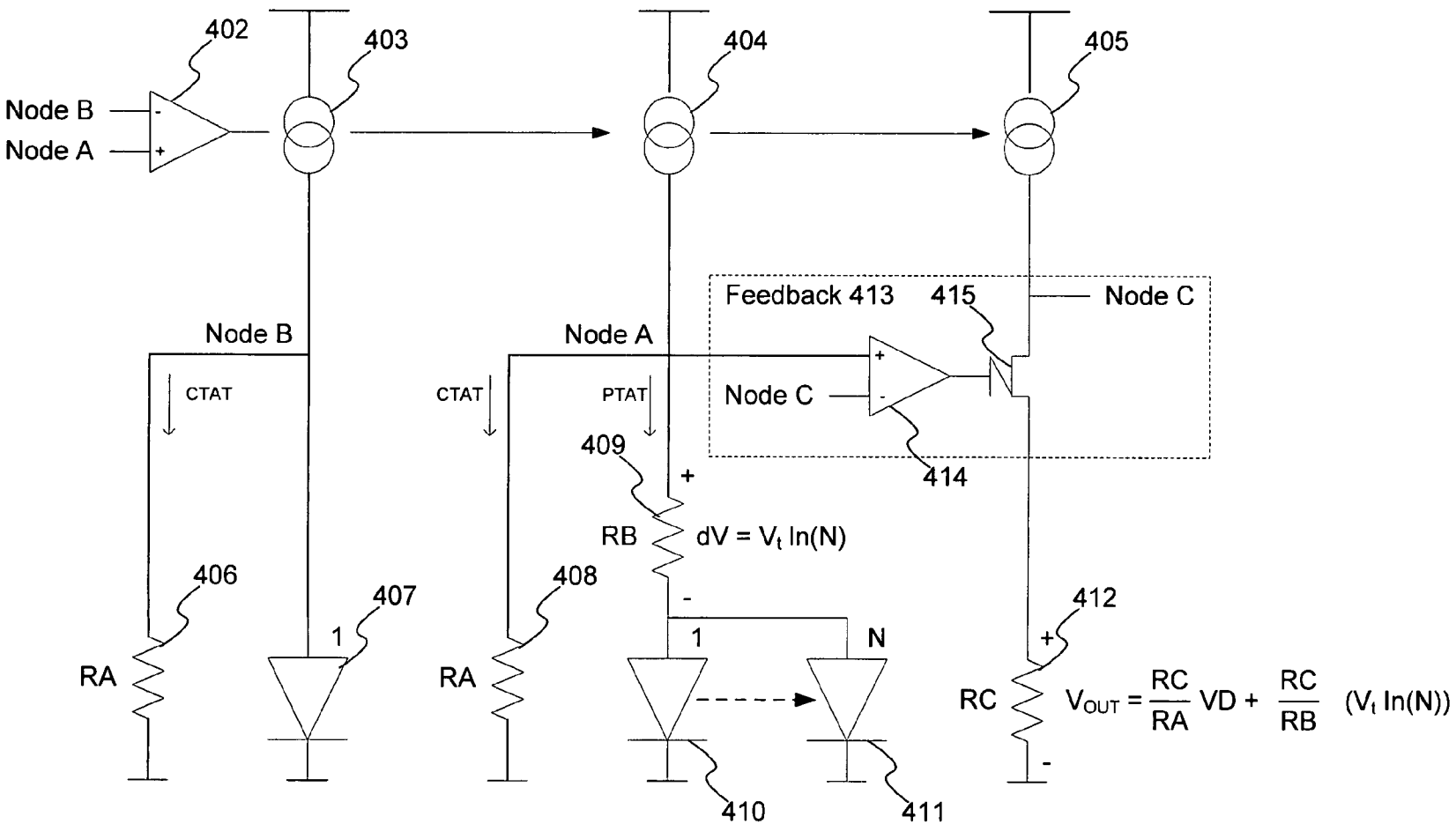
FIGS. 4 and 5 illustrate a preferred embodiment of a bandgap reference generation circuit in accordance with the present invention.

FIG. 4 illustrates a preferred embodiment of a bandgap reference generation circuit in accordance with the present invention. The circuit includes an operational amplifier (op amp) 402, and three bias paths, connected as illustrated. The first bias path includes a first current source 403, resistor 406, and diode 407. The second bias path includes a second current source 404, resistors 408 and 409, and diodes 410–411. The third bias path includes current source 405, transistor 415, and resistor 412. Nodes A and B connect to the inputs of op amp 402, while the voltage output of op amp 402 controls the current magnitude of current sources 403–405. These connections form a negative feedback control loop which forces the potentials of nodes A and B to be essentially identical. If the electrical parameters of current sources 403 and 404 are well matched, this negative feedback network forces the current magnitudes in both current sources 403–404 to be equal. Nodes A and C connect to the inputs of a second op amp 414, while the output voltage of op amp 414 controls the gate voltage of transistor 415. In this embodiment, the transistor 415 is a p-channel CMOS transistor, however, other types of transistors can be used as well. This connection forms a negative feedback control loop 413 which forces the potential of nodes A and C to be essentially identical. Furthermore, both negative feedback loops together force nodes A, B, and C to be essentially identical. As the voltage at Nodes A and B change via the first feedback loop, the voltage at Node C also changes via the second feedback loop 413. If the electrical parameters of current source 405 match those parameters of current sources 403 and 404, this negative feedback network forces the current magnitude of current 405 to equal the current magnitudes of sources 403 and 404. Because the forward voltage VD of diodes decreases linearly with temperature, the current in resistor 406 and 408 also decrease linearly with temperature. Such behavior is known as complimentary to absolute temperature (CTAT). Conversely, the current in resistor 409 is found to increase linearly with temperature, yielding a behavior known as proportional to absolute temperature (PTAT). If the CTAT and PTAT behaviors are carefully selected to be complimentary, the sum of both yields a behavior which does not change with temperature. The voltages across current sources 403–405 are maintained constant by the two negative feedback loops, regardless of what supply potential is present. Thus, unlike conventional bandgap reference generation circuits, even with low supply voltages, the reference voltage, $V_{OUT}$, is maintained over variations in process, temperature, and supply voltage.

Figure 5:
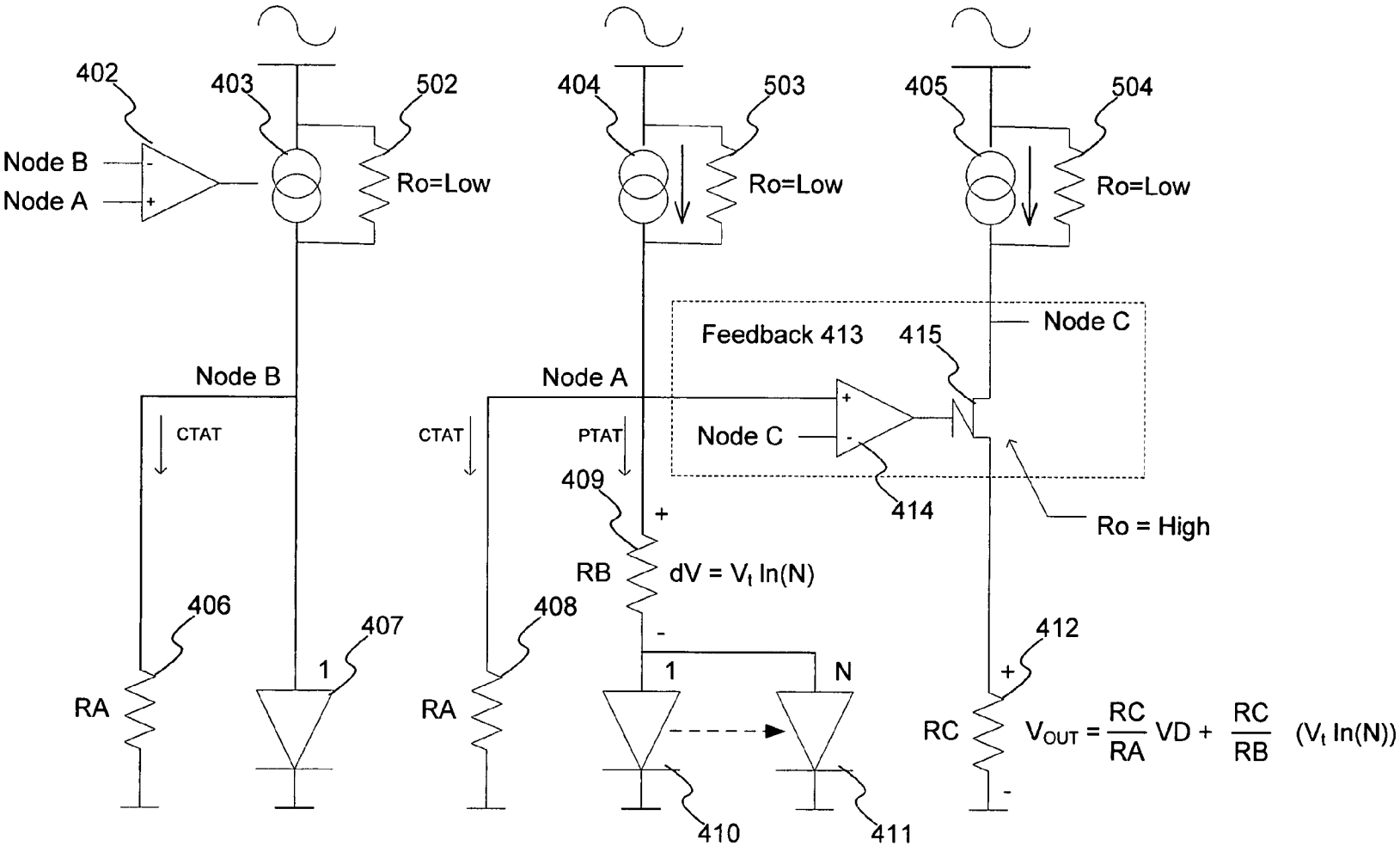

In addition, as illustrated in FIG. 5, the second negative feedback loop 413 also maintains a high impedance on the output of transistor 415. Hence, the output impedance of transistor 415 is significantly greater than resistor 412. Therefore, the PSRR is greatly improved over conventional bandgap reference generation circuits.

An improved bandgap reference generation circuit has been disclosed. The improved circuit utilizes two feedback loops to maintain the voltages at each bias path and across the output current sources to be essentially the same, such that the current source magnitudes track over variations in process, temperature, and supply voltage. The accuracy of the reference voltage is maintained even at low supply voltages. A high output impedance is also maintained by the second feedback loop. In this manner, an improved power supply rejection ratio can be obtained.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A voltage reference circuit, comprising:

a first bias path comprising a first current source;

a second bias path comprising a second current source;

a third bias path comprising a third current source, a transistor with a source coupled to the third current source, and a resistor with a terminal coupled to a drain of the transistor, wherein a reference voltage is provided across the resistor;

a first feedback loop, comprising a first operational amplifier with an inverting input coupled to the first bias path, a non-inverting input coupled to the second bias path, and an output coupled to the first, second, and third current sources; and a second feedback loop, comprising the transistor, and a second operational amplifier with an output coupled to a gate of the transistor, a non-inverting input coupled to the second bias path, and an inverting input coupled to the third bias path, wherein when electrical parameters of the first, second and third current sources are matched, current magnitudes of the first, second, and third current sources are essentially equal.

2. The circuit of claim 1, wherein the first bias path further comprises:

a second resistor with a terminal coupled to the first current source at a first node, and a first diode with an anode coupled to the first current source at the first node.

3. The circuit of claim 2, wherein the second bias path further comprises:

a third resistor with a terminal coupled to the second current source at the second node;

a fourth resistor with a first terminal coupled to the second current source at the second node; and a plurality of diodes with anodes coupled to a second terminal of the fourth resistor.

4. The circuit of claim 3, wherein the inverting input of the first operational amplifier is coupled to the first node and the non-inverting input of the first operational amplifier is coupled to the second node.

5. The circuit of claim 3, wherein the non-inverting input of the second operational amplifier is coupled to the second node, and the inverting input of the second operational amplifier is coupled to the third node.

6. The circuit of claim 3, wherein potentials at the first node, the second node, and the third nodes are essentially identical.

7. The circuit of claim 1, wherein a supply voltage is approximately 0.8V or greater.

8. A voltage reference circuit, comprising:

a first bias path, comprising:

a first current source, a first resistor with a terminal coupled to the first current source at a first node, and a first diode with an anode coupled to the first current source at the first node;

a second bias path, comprising:

a second current source, and a second resistor with a terminal coupled to the second current source at a second node, a third resistor with a first terminal coupled to the second current source at the second node, and a plurality of diodes with anodes coupled to a second terminal of the third resistor;

a third bias path, comprising:

a third current source, a transistor with a source coupled to the third current source at a third node, and a fourth resistor with a terminal coupled to a drain of the transistor, wherein a reference voltage is provided across the fourth resistor;

a first feedback loop, comprising a first operational amplifier with an inverting input coupled to the first node, a non-inverting input coupled to the second node, and an output coupled to the first, second, and third current sources; and a second feedback loop, comprising the transistor, and a second operational amplifier with an output coupled to a gate of the transistor, a non-inverting input coupled to the second node, and an inverting input coupled to the third node.

9. The circuit of claim 8, wherein potentials at the first node, the second node, and the third nodes are essentially identical.

10. The circuit of claim 8, wherein when electrical parameters of the first, second and third current sources are matched, current magnitudes of the first, second, and third current sources are essentially equal.

11. The circuit of claim 8, wherein a supply voltage is approximately 0.8V or greater.

* * * * *